United States Patent [19]

Nicholson

[11] Patent Number: 5,038,500

[45] Date of Patent: Aug. 13, 1991

[54] BOOT HAVING GRITTED OUTSOLE

[75] Inventor: Jon E. Nicholson, LaCrescent, Minn.

[73] Assignee: LaCrosse Footwear, Inc., LaCrosse, Wis.

[21] Appl. No.: 268,705

[22] Filed: Nov. 8, 1988

[51] Int. Cl.[5] ..... A43C 15/00

[52] U.S. Cl. ..... 36/59 C; 36/59 R; 36/59 B; 51/299; 12/142 RS; 12/146 B

[58] Field of Search ..... 36/59 R, 59 A, 59 B, 36/59 C; 51/299; 12/146 B, 142 RS

[56] References Cited

U.S. PATENT DOCUMENTS

| | | | |
|---|---|---|---|
| 1,668,476 | 5/1928 | Wescott | 51/299 X |
| 1,796,399 | 3/1931 | Roodhouse . | |
| 2,031,196 | 2/1936 | Vicente | 36/59 |
| 2,084,784 | 6/1937 | Stahl | 36/59 B |
| 2,552,500 | 5/1951 | von Doenhoff | 51/299 X |
| 3,528,943 | 9/1970 | Goldberg et al. | 260/41 |
| 3,555,697 | 1/1971 | Dassler | 36/2.5 |
| 3,573,155 | 3/1971 | Mitchell | 161/162 |
| 3,629,051 | 12/1971 | Mitchell | 161/162 |
| 3,802,951 | 4/1974 | Mitchell | 161/162 |
| 4,151,662 | 5/1979 | Vistins | 36/98 |
| 4,160,331 | 7/1979 | Bell | 36/59 B |
| 4,333,192 | 6/1982 | Stockli et al. | 12/142 E |
| 4,349,403 | 9/1982 | Blenner et al. | 156/272.6 |
| 4,394,205 | 7/1983 | Blenner | 156/307.3 |
| 4,446,635 | 5/1984 | Hayden, Jr. | 36/116 |
| 4,483,962 | 11/1984 | Sadowski | 524/552 |
| 4,581,092 | 4/1986 | Westley | 156/306.9 |

FOREIGN PATENT DOCUMENTS

| | | | |
|---|---|---|---|
| 61-166710 | 7/1986 | Japan . | |
| 991995 | 2/1983 | U.S.S.R. | 36/59 R |

OTHER PUBLICATIONS

"NonSlip-er" brochure, Jordan David Safety Products, 4 pages, copyright 1980.

*Primary Examiner*—Paul T. Sewell
*Assistant Examiner*—Thomas P. Hilliard
*Attorney, Agent, or Firm*—Foley & Lardner

[57] ABSTRACT

A gritted outsole suitable for intervulcanization with a rubber boot has a layer of inorganic grit particles secured to its outer face. The grit particles are chemically bonded to the rubber of the outsole by an adhesive having both polar and non-polar components. The adhesive may comprise a pair of successive primer coatings on the grit particles. The first primer coating is made of a polar organic polymer which has a high affinity for the grit particle. The second primer overcoats the first primer and serves to intervulcanize the first primer with the rubber of the outsole. An intervulcanized gritted outsole according to the invention provides improved traction and has greater durability than conventional gritted outsoles.

17 Claims, 1 Drawing Sheet

BOOT HAVING GRITTED OUTSOLE

TECHNICAL FIELD

This invention relates to outsoles for use in boots or shoes, and particularly to outsoles having a layer of grit on the outer surface thereof to provide improved traction on slippery surfaces.

BACKGROUND OF THE INVENTION

A variety of gripping compositions have been applied to outsoles of boots and shoes in order to improve the slip resistance of such footwear under slippery conditions such as ice or snow. Early patents proposed, for example, securing an abrasive anti-slip patch onto a sole bottom (see Roodhouse U.S. Pat. No. 1,796,399 issued Mar. 17, 1931) or providing a sole (Vicente U.S. Pat. No. 2,031,196 issued Feb. 18, 1936.) Particles of grit such as silicon carbide or sand have been secured to a sole bottom with conventional adhesives. See, for example, Bell, U.S. Pat. No. 4,160,331 issued Jul. 10, 1979. Textured anti-slip soles are well known. See, e.g., Vistins, U.S. Pat. No. 4,151,662 issued May 1, 1979 and Dassler, U.S. Pat. No. 3,555,697 issued Jan. 19, 1971. Overshoes having gripping elements such as aluminum screens and rubber pads have also been proposed, as disclosed in Hayden Jr., U.S. Pat. No. 4,446,635, issued May 8, 1984. Most of these designs have proven impractical or economically infeasible, and are not currently in commercial use.

Other known nonslip particles have been made by embedding particles such as aluminum pieces or shavings or pieces of porous material in a matrix of rubber or resin. See, for example, Mitchell, U.S. Pat. Nos. 3,573,155 issued Mar. 30, 1971, 3,629,051 issued Dec. 21, 1971, and 3,802,951 issued Apr. 9, 1974, as well as Japanese Patent Publication No. 61-166710. These systems generally require the entire sole to contain the particulate material, even though only the particles or pieces exposed on the outer surface of the sole actually provide anti-slip effects.

The foregoing patent to Bell describes a shoe having inset layers of grit on the bottom of the sole. Such a sole does not require the grit to be distributed throughout the entire sole, but suffers from poor durability. Specifically, inorganic grit particles have a poor affinity for rubber, and the grit layers tend to break off easily when simply glued to the sole bottom. The present invention provides an improved gritted outsole which addresses this problem.

SUMMARY OF THE INVENTION

The present invention provides a gritted outsole having superior nonslip properties and improved durability as compared to known gritted soles. A vulcanized rubber outsole according to the invention has a layer of grit particles secured to one of the faces thereof by an adhesive having both polar and non-polar components. Such an adhesive may comprise a monomer containing both polar and reactive non-polar segments. Alternatively, the adhesive may comprise a pair of first and second primers. The first primer is a polar organic polymer which is coated on the outer surfaces of the grit particles. The second primer is an organic polymer which is coated on the grit particles over the first primer. Upon vulcanization of the sole, the second primer intervulcanizes with the rubber of the sole and the first primer so that the grit particles are chemically bonded to the sole.

The present invention further provides a boot (or shoe) including a boot body and a gritted outsole as described above. If the boot body is also made of rubber, then the entire assembly, including the gritted outsole, can be intervulcanized.

A process for making a gritted outsole according to the invention includes the steps of coating a paste containing grit particles and unvulcanized rubber on a face of a rubber outsole, drying the paste to form a gritted rubber layer on the outsole, and intervulcanizing the thus formed rubber layer with the outsole. A boot according to the invention may then be made by the additional step of securing the inner face of the outsole to the boot body. The paste may be made by dissolving unvulcanized rubber in a non-polar organic solvent in the presence of a vulcanizing agent for the rubber, and mixing the rubber solution containing the vulcanizing agent with particles of inorganic grit in amounts sufficient to form a flowable paste.

BRIEF DESCRIPTION OF THE DRAWING

The invention will further be described with reference to the accompanying drawing, wherein like numerals denote like elements, and.

DETAILED DESCRIPTION

Figure 1:
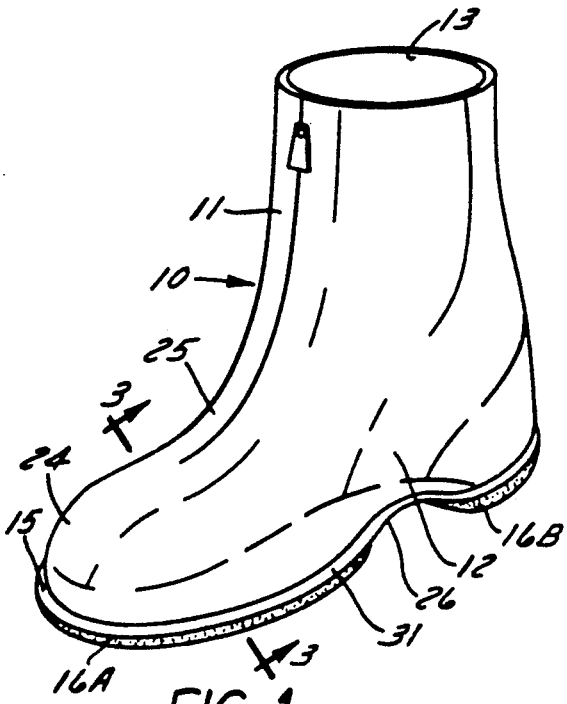
FIG. 1 is a perspective view of a boot according to the present invention.
Figure 2:
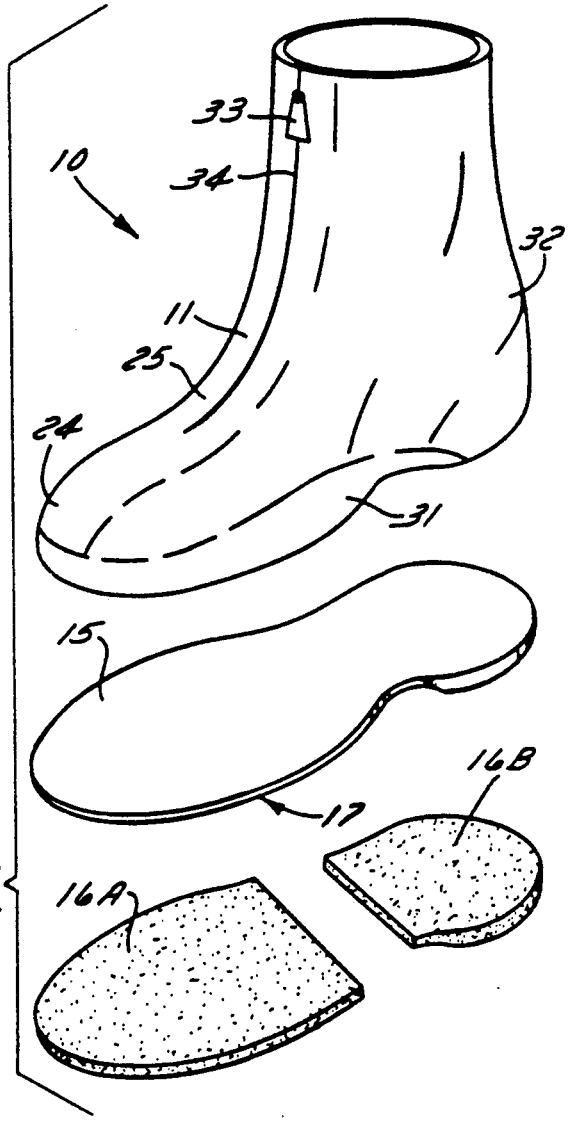
FIG. 2 is a partly exploded view of the boot shown in FIG. 1.

Referring now to FIGS. 1–4, a boot 10 according to the present invention includes a boot body 11 secured to the inner face of a gritted outsole 15. Boot body 11 includes a rubber boot upper 12, a lining 13 such as fabric-backed felt, secured to the inside of upper 12, and a foot-shaped fabric filler (insole) 14 which overlies the lower peripheral edges of upper 12 and lining 13. Boot body 11 is assembled in a conventional manner, and any suitable means, such as intervulcanization, sewing, an adhesive, or the like, may be used to secure together the components of boot body 11. Outsole base 15 has a pair of front and rear grit layers 16A, 16B on the outer (bottom) face 17 thereof as shown in FIGS. 1–4.

Figure 5:
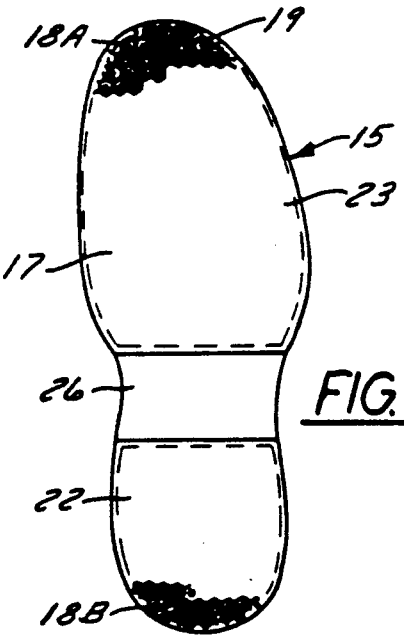
FIG. 5 is a bottom view of the boot shown in FIG. 1, with the grit layers removed.
Figure 3:
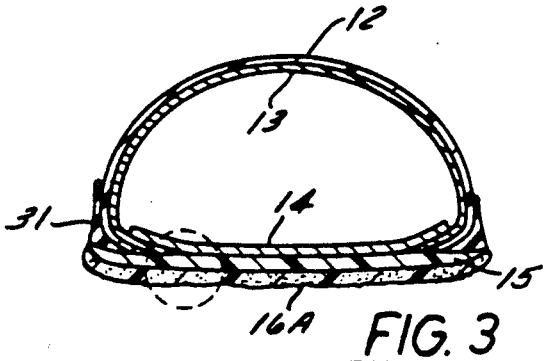
FIG. 3 is a cross sectional view taken along the line 3—3 in FIG. 1.
Figure 6:
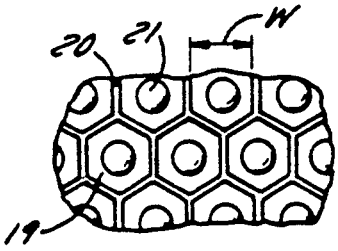
FIG. 6 is an enlarged view of the outsole pattern shown in FIG. 5.
Figure 4:
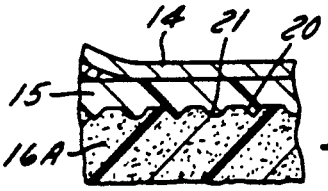
FIG. 4 is an enlarged view of the circled portion of FIG. 3.

Referring to FIGS. 5 and 6, outer face 17 of outsole 15 has respective front and rear relief surface portions 18A, 18B on the surface thereof which aid in forming grit layers 16A, 16B evenly and provide additional surface for attachment of layers 16A, 16B, respectively. Relief portions 18A, 18B preferably define a pattern, especially a polygonal pattern such as a hexagonal honeycomb made up of a series of parallel rows of adjoining cells 19 defined by a network of ridges 20. A convex projection 21 centered in each cell 19 provides additional surface for attachment of grit layers 16A, 16B. Each cell 19 preferably has a width (W) between parallel ridges in the range of about 4 to 16 mm. The height of ridges 20 and projections 21 may vary in the range of about 2 to 4 mm. Within these ranges, relief portions 18A, 18B are especially effective for allowing grit layers 16A, 16B to be formed evenly on the sole bottom without hindering contact between grit layers 16A, 16B and the floor or surface boot 10 contacts when it is worn.

Grit layers 16A, 16B may cover the entire bottom surface 17 of outsole 15, or only selected portions thereof, i.e., on the heel 22 and the front portion 23 of outsole 15 which underlies the toe and instep portions 24 and 25 of boot body 11. The shank 26 of outsole 15 which spans heel 22 and front portion 23 does not generally contact the ground and thus there is no need to provide a layer of grit thereon. Boot upper 12 may include a welt 31 interposed between upper 12 and outsole 15 which intervulcanizes therewith. In the embodiment shown, welt 31 extends forwardly from the front end of heel 22. In other words, at heel 22, upper 12 and outsole 15 are directly intervulcanized together. Upper 12 may also include a reinforced quarter 32 and a zipper construction 33 including a collapsible tongue (not shown) spanning a zipper opening 34.

Grit layers 16A, 16B of outsole 15 are each essentially a polymeric matrix in which a multitude of small grit particles are embedded. The grit particles should have irregular surfaces in order to provide improved gripping characteristics to the sole. If the grit particles are insufficiently hard, the irregular surface will quickly smooth out as the boot is worn, and thereby lose much of its gripping ability. For example, pumice having a Mohs hardness of 6, when used as the grit material in the present invention, rapidly abraded and smoothed out.

The grit particles are thus preferably made of an inorganic compound having a Mohs hardness of at least about 7, and most preferably having a Mohs hardness of at least 9. Such compounds include, for example, quartz ($SiO_2$), zirconia ($ZrO_2$), beryllia (BeO), topaz ($(AlF)_2SiO_4$), and garnet ($Al_2O_3.3FeO.3SiO_2$). Metal oxides such as aluminum oxide ($Al_2O_3$) are particularly suitable. Materials having a Mohs hardness of less than 6 are generally unsuitable for use as the grit particles in the present invention because such materials fail to resist the abrasion which occurs as the boot is worn.

The grit particles should be sufficiently small so that a thin layer of uncured rubber containing the grit particles can be evenly applied to the outsole surface, and so that the total surface area of the grit particles is sufficiently great to insure a strong chemical bond, as will be described hereafter. In general, the grit particles preferably have an average particle size (greatest dimension) in the range of from about 0.7 to 2.4 mm. Particles having sizes of about 2.5 mm or larger tend to break off when the sole flexes.

The preferred grit particles according to the invention are made up of aluminum oxide molecules having a poor affinity for non-polar organic resins such as rubber. Such small particles of inorganic grit thus do not adhere well to natural rubber or synthetic rubbers similar to natural rubber. The present invention solves this problem by securing the grit particles with an adhesive having both polar and non-polar components which can bond to both the grit particles and the rubber of the outsole.

According to a preferred form of the invention, the grit particles are coated successively with a pair of first and second primers which securely bond the particles to the rubber of the outsole. The first primer coating should comprise a polar polymeric material having a relatively good affinity for the inorganic grit particles. Such polymers include, for example, elastomeric organic polymers highly substituted with polar substituents such as halogen atoms, e.g. chlorine or fluorine atoms, or oxycarbon groups such as ester, ether, or keto groups.

The second primer cross-links or intervulcanizes the first primer with the surrounding natural or synthetic rubber. The second primer is applied as a second coating over the grit particles already coated with the first primer. The second primer should be substantially less polar than the first primer, so that it is compatible with the surrounding rubber, and preferably has reactive cross-linking groups grafted thereon. Elastomeric adhesives such as halogen or methacrylate-substituted polyisoprenes are particularly preferred second primers, but a variety of available elastomeric adhesives commonly used to bond aluminum to rubber can also be used. Such bonding adhesives include Thixon D-21437 or 913, or Chemlok 205 and either 234A or 236A.

The polymeric adhesive used to bond the grit particles to the outsole may also comprise a single, ambifunctional monomer having polar and reactive non-polar segments. Such an adhesive may comprise an organic monomer substituted with polar groups such as $—Si(OH)_3$ or $—Ti(OH)_3$. One such compound is a silane coupling agent made of monomers having the formula $X—CH_2—CH_2—CH_2—Si(OCH_3)_3$, wherein X is a reactive group such as a vinyl group. The non-polar segments of the polymer have an affinity for the rubber of the outsole, and the polar segments have an affinity for the grit particles, resulting in a stronger chemical bond.

The present invention provides a process for making a gritted outsole using the foregoing materials. Initially, the desired grit powder is thoroughly mixed with the first primer so that the grit particles are completely covered with the primer. The elastomer in the primer is dissolved in an organic solvent. A typical solvent is a mixture of xylene, methyl ethyl ketone, and isopropyl alcohol, with a small amount of carbon tetrachloride. The grit and primer solution are thoroughly mixed together so that the grit particles are thoroughly coated with the first primer. The resulting mixture is then dried by any suitable means, e.g., by pouring the mixture out on a flat surface to a thickness of less than about 10 mm and allowing the mixture to air dry until the solvent has evaporated. This generally takes several hours at room temperature. The coated grit is then ground down to its original particle size by any suitable means, such as a mortar and pestle. This breaks up agglomerates of coated grit particles which form as a result of the drying step.

The coated, deagglomerated grit is then mixed with a solution of the second primer to form a second coating on the grit particles. The coated particles are then dried as before, and ground back down to approximately their original particle size. The coated particles are then ready be mixed with an unvulcanized rubber solution to form a paste which can be applied to the outsole.

The foregoing unvulcanized rubber solution is preferably prepared by the following process. A pair of first and second dry rubber mixtures are separately prepared, then combined in an organic solvent to form a rubber solution. The first dry rubber mixture contains rubber and a curing agent, and can optionally also contain a cure retarding agent and an antioxidant. The rubber may be natural rubber or any suitable artificial rubber such as polybutadiene rubber (BR), polyisoprene rubber (IR), styrene-butadiene rubber (SBR), ethylene-propylene terpolymer (EPDM), and combinations thereof. A particularly preferred rubber for the paste according to the invention is a mixture of natural rubber and SBR rubber in proportions of roughly 25–50 weight percent SBR rubber and 50–75 weight percent natural rubber. The SBR rubber used in the paste according to the invention also preferably contains about 30 to 55 weight percent of carbon black particles. Carbon black provides the paste, which will form all or part of the bottom surface of the outsole, with improved abrasion resistance. To be effective for this purpose, the total amount of carbon black relative to the total amount of rubber in the paste should be in the range of 0.5:1 to 1.5:1.

For a mixture of natural and SBR rubber according to the invention, the preferred curing agent is a mixture of sulfur and zinc oxide. The first dry rubber mixture may also contain a cure retarding agent for the selected rubber, such as salicylic acid for a mixture of natural and SBR rubber. A conventional antioxidant should also be included if natural rubber is being used. Hindered phenolic antioxidant compounds are particularly preferred for this purpose. Finally, for the reason noted below, the first rubber mixture should be free of conventional accelerators.

The first dry rubber mixture is milled on a conventional rubber mill until the ingredients, including the rubber, curing agent, abrasion resisting agent (carbon black) and the other additives, are thoroughly mixed to form a firm elastic mass. This generally takes only a few minutes. During milling, the carbon black generates a large amount of frictional heat under the shear stress of mixing. This heat can cause the rubber in the mixture to prematurely vulcanize unless the accelerator is omitted from the first mixture.

A second, generally smaller mixture is also prepared which contains the accelerator distributed in rubber. Any commonly employed vulcanization accelerators may be used, particularly combinations of organic accelerators such as mercaptobenzothiazole or benzothiazyl disulfide combined with diphenylguanidine or thiuram disulfide. A particularly preferred combination is a mixture of effective amounts of diphenylguanidine and benzothiazyl disulfide in natural rubber, wherein the two accelerators constitute about 0.4 to 0.6 weight percent of the total mixture.

The second mixture is milled in the same manner as the first mixture, and then selected amounts of each mixture are added to a container containing an organic solvent. Liquid alkanes, such as an equal mixture of hexane and heptane, are preferred as the organic solvent, although other organic solvents such as toluene or 1,1,1-trichloroethane can also be used. The two dry rubber mixtures are added in amounts corresponding to the desired composition of the final rubber mixture. The organic solvent is used in an amount sufficient to bring the viscosity of the resulting solution in the range of about 22,500–24,500 cps. The resulting rubber solution dissolves the unvulcanized rubber contained therein, but other ingredients, e.g., carbon black, are merely suspended therein. A viscosity close to about 23,500 cps is optimal for forming a paste which can be applied to an outsole.

The rubber solution is then combined with the twice-coated grit material to form a paste. To obtain a paste which can be readily applied manually to an outsole using an implement such as a putty knife, the amount of the rubber solution should be in the range of from about 2 to 3 parts by volume rubber solution to 1 part by volume twice-coated grit. The ingredients are mixed until the grit is thoroughly distributed in the rubber solution, and the amounts of ingredients are adjusted as needed to obtain the desired paste consistency.

The paste is then thinly applied to the bottom surface of the outsole and allowed to dry for several hours. The gritted outsole is then mounted on a rubber boot or shoe in a conventional manner, and the assembly is then heated to vulcanize the rubber, e.g., at a temperature of at least 270° C. for at least about 1 hour. During this process, the two primers surrounding the grit particles cross-link (intervulcanize) with the rubber in the paste, and the rubber in the paste similarly intervulcanizes with the rubber of the outsole, so that a unitary vulcanized outsole is obtained. In the alternative, a prevulcanized outsole may be used, if the bottom surface thereof is suitably treated, e.g., by abrasion, to firmly bond to the subsequently applied gritted layer.

The second primer is important for providing adhesion between the first polymer and the surrounding rubber. Omitting use of either of the two primers in the foregoing embodiment of a process according to the invention yields poor results. Thus, the second primer, positioned as an overcoating on the first primer, cross-links the first primer with the surrounding rubber. The first primer chemically bonds the grit particles to the surrounding elastomeric matrix. "Chemical bonding" as meant herein refers to the molecular attraction which occurs between compounds having highly polar groups. Thus, the first primer is a polymer which can chemically bond to the inorganic grit particles, and the second primer is a polymer which can secure the first primer to the surrounding rubber, preferably by intervulcanization.

The following examples illustrate the production of gritted outsoles according to the invention.

EXAMPLE 1

Approximately 0.9 liter (one quart) of #24 aluminum oxide ($Al_2O_3$) grit having an average particle size of about 0.794 mm (1/32 inch) and 100 ml of Chemlok 289 fluorocarbon elastomer adhesive primer are added to a plastic pail and mixed together so that the surfaces of the grit particles are completely covered by the primer. The resulting mixture is then poured out onto a flat surface to a thickness of about 6 mm for about 2 hours at room temperature to evaporate the solvent. The coated grit is then ground down to its original particle size (about 0.8 mm) using a mortar and pestle. This substantially deagglomerates the grit. The coated, deagglomerated grit is then mixed with 100 ml of Chemlok 290 elastomeric adhesive primer to coat the grit a second time. As before, the resulting mixture is poured onto a flat surface to evaporate the solvent, and then ground back down to approximately the original particle size of the grit.

A solution of unvulcanized rubber is then prepared. The following dry ingredients are combined on a mill to form a first dry rubber mixture:

| | |
|---|---|
| Solid natural rubber | 24.95 kg |
| Solid mixture of SBR rubber (68 wt. %) and carbon black (32 wt. %) | 27.22 kg |
| Zinc oxide-in-oil dispersion (Zic Stick 85) | 1.36 kg |

-continued

| | |
|---|---|
| Salicylic acid | 181 g |
| Sulfur | 907 g |
| Hindered phenolic antioxidant (A.O. 872) | 136 g |

Milling is carried out for about 10 minutes until a firm elastic mass is obtained. Then, a second dry rubber mixture is obtained by separately milling the following ingredients in the same manner:

| | |
|---|---|
| Solid natural rubber | 1.5 kg |
| diphenyl guanidene (DPG) | 45 g |
| benzothiazyl disulfide (MBTS) | 225 g |

A rubber solution is then made by dissolving 27.22 kg of the first dry mixture and 1.77 kg of the second dry mixture in 30 gallons (113.6 1) of a solvent comprising a 50/50 by volume mixture of heptane and hexane. Some of the non-rubber ingredients are suspended in the solvent rather than dissolved. The ingredients are then mixed until smooth, and additional solvent or dry materials as described above are added as needed to adjust the viscosity of the mixture to 23,500 cps.

Approximately 2.5 liters of the rubber solution is added to about 1 liter of the pretreated grit. The resulting paste is then applied manually using a putty knife to the bottom surface of an unvulcanized rubber outsole. The rubber of the outsole is 57% natural rubber and 43% SBR rubber. The outsole also contains a small amount of carbon black to enhance abrasion resistance and an amount of sulfur effective as a cross-linking agent. The outsole has a surface relief pattern in a honeycomb shape which helps prevent the rubber-grit mixture from flowing or slumping unevenly. In the illustrated embodiment, ridges 20 and projections 21 of the honeycomb pattern are about 1.6 mm in height, and the width W of each cell (see FIG. 6) is about 1 cm.

The coated outsole is allowed to dry overnight. The gritted outsole is then mounted on a rubber boot, and the assembly is then vulcanized at about 138° C. for 1.5 hours. During this process the two primers, the rubber of the paste composition and the rubber of the outsole intervulcanize to form a unitary outsole in which the grit is embedded.

A boot made according to the foregoing procedure provided superior traction on slippery surfaces, such as snow and ice-covered sidewalks, but did not significantly harm floor surfaces when worn indoors. The grit remained firmly bonded to the outsole and did not tend to fall off or break off in chunks from the outsole.

EXAMPLE 2

Five silane adhesives having both polar and non-polar segments were used to prepare outsoles according to the invention. The silanes used were Dow Corning 6100, X1-6125, and 6020. The following procedure was used for each silane. A mixture of 400 ml distilled water, 3 ml glacial acetic acid and 2 ml of the silane was prepared and allowed to stand for 5 minutes. During this time the silane went into solution and white silica precipitated out. Aluminum oxide grit (150 ml) was then added to the mixture, which was then stirred to completely wet the grit and allowed to stand. The solution was then poured off and the grit allowed to dry. The thus-prepared grit was then mixed with a rubber solution as in Example 1, and a gritted outsole was prepared according to the procedure of Example 1. The resulting outsoles were found to release grit to a somewhat greater extent than the outsoles prepared in Example 1, but were substantially better than comparable outsoles prepared using untreated grit.

It will be understood that modifications may be made in the described methods and products according to the invention without departing from the scope of the invention as expressed in the appended claims.

I claim:

1. A gritted outsole suitable for mounting onto a boot, comprising a vulcanized rubber outsole having inorganic grit particles secured to a face thereof by a polymeric adhesive having both polar and non-polar components, wherein the polar component has an affinity for and bonds to the grit particles, and the non-polar component has an affinity for and bonds to the rubber outsole.

2. The gritted outsole of claim 1, wherein said adhesive comprises a pair of first and second primers, said first primer comprising a polar organic polymer coated on the outer surfaces of said particles, and said second primer comprising an organic polymer coated on the outer surfaces of said particles over said first primer, which second primer is intervulcanized with both of said first primer and said rubber of said outsole.

3. The gritted outsole of claim 1, wherein said grit particles consist essentially of an inorganic oxide, and said particles have a Mohs hardness of at least about 7 and an average particle size in the range of about 0.7 to 2.4 mm.

4. The gritted outsole of claim 1, wherein said outsole further comprises an outsole base having a layer containing said grit particles laminated on a face thereof, said layer consisting essentially of vulcanized rubber having said particles substantially uniformly distributed therein.

5. The outsole of claim 4, wherein said rubber in said layer consists essentially of natural rubber, SBR rubber, and an amount of carbon black effective for imparting enhanced abrasion resistance to said layer.

6. The outsole of claim 2, wherein said polar organic polymer consists essentially of an elastomeric adhesive substituted with polar groups.

7. The outsole of claim 6, wherein said polar groups are halogen atoms or oxycarbon functional groups.

8. The outsole of claim 6, wherein said second primer consists essentially of a substantially non-polar elastomeric adhesive.

9. The outsole of claim 1, wherein said adhesive comprises an organic monomer having polar and reactive non-polar segments.

10. The outsole of claim 1, wherein said adhesive comprises a coating on the outer surfaces of said grit particles.

11. The outsole of claim 4, wherein said outsole base has a relief pattern thereon, and said layer is laminated over said relief pattern.

12. The outsole of claim 11, wherein said relief pattern comprises a series of adjacent rows of polygonal cells.

13. In a boot including a boot body, an outsole, and means for securing an inner face of the outsole to said boot body, the improvement which comprises:

said outsole consists essentially of vulcanized rubber and has inorganic grit particles secured to a face thereof by a polymeric adhesive having both polar and non-polar components, wherein the polar component has an affinity for and bonds to the grit particles and the non-polar component has an affinity for and bonds to the rubber outsole.

14. The boot of claim 13, wherein said adhesive comprises a pair of first and second primers, said first primer comprising a polar organic polymer coated on the outer surfaces of said particles, and said second primer comprising an organic polymer coated on the outer surfaces of said particles over said first primer, which second primer is intervulcanized with both of said first primer and said rubber of said outsole.

15. A gritted outsole, made by a process comprising:

coating a paste containing grit particles and unvulcanized rubber on the bottom surface of an uncured rubber outsole;

drying said paste to form a gritted rubber layer on said outsole; and intervulcanizing said layer with said outsole to form said gritted outsole;

wherein said paste is made by the steps of:

dissolving unvulcanized rubber in a non-polar organic solvent to form a rubber solution;

adding a vulcanizing agent to said rubber solution; and mixing said rubber solution with particles of inorganic grit in an amount sufficient to form a flowable paste; and wherein said grit is made by the steps of:

coating particles of a metal oxide having a Mohs hardness of at least about 7 with a polar elastomeric adhesive; and then coating said coated metal oxide particles with a substantially non-polar elastomeric adhesive.

16. The gritted outsole of claim 1, wherein said non-polar component is cross-linked with said vulcanized rubber outsole.

17. In a boot including a boot body and an outsole secured to the underside of the boot body, the improvement which comprises:

the outsole is made of vulcanized rubber and has inorganic oxide grit particles secured to a face thereof by a polymeric adhesive having both polar and non-polar components, the grit particles having a Mohs hardness of at least 7 and an average particle size of about 0.7 to 2.4 mm, and the adhesive comprises a pair of first and second primers, the first primer comprising a polar organic polymer coated on the outer surfaces of the particles, and the second primer comprising an organic polymer coated on the surfaces of the particles over the first primer, which second primer is intervulcanized with both of the first primer and the rubber of the outsole, the first primer having an affinity for and bonding to the grit particles.

* * * * *